US011470964B2

(12) United States Patent
Szlapka et al.

(10) Patent No.: US 11,470,964 B2
(45) Date of Patent: Oct. 18, 2022

(54) PIECE OF FURNITURE OR DOMESTIC APPLIANCE AND METHOD FOR MOUNTING A FUNCTIONAL UNIT OF A DRAWER ELEMENT IN A PIECE OF FURNITURE OR DOMESTIC APPLIANCE

(71) Applicant: PAUL HETTICH GMBH & CO. KG, Kirchlengern (DE)

(72) Inventors: Timo Szlapka, Bielefeld (DE); Sebastian Bastkowski, Herford (DE); Thorsten Hötger, Enger (DE); Gerrit Staufenberg, Osnabrück (DE); Ulrich Ratsch, Bad Salzuflen (DE); Stefan Klaus, Bünde (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 16/975,900

(22) PCT Filed: Feb. 8, 2019

(86) PCT No.: PCT/EP2019/053171
§ 371 (c)(1),
(2) Date: Aug. 26, 2020

(87) PCT Pub. No.: WO2019/166205
PCT Pub. Date: Sep. 6, 2019

(65) Prior Publication Data

US 2021/0000256 A1 Jan. 7, 2021

(30) Foreign Application Priority Data

Feb. 27, 2018 (DE) ..... 10 2018 104 398.8

(51) Int. Cl.
*A47B 88/467* (2017.01)
*A47B 88/477* (2017.01)
(Continued)

(52) U.S. Cl.
CPC ..... *A47B 88/477* (2017.01); *A47B 88/463* (2017.01); *A47B 88/467* (2017.01); *A47B 88/919* (2017.01); *A47B 88/941* (2017.01)

(58) Field of Classification Search
CPC ... A47B 88/463; A47B 88/467; A47B 88/477; A47B 88/941; A47B 88/919
(Continued)

(56) References Cited

U.S. PATENT DOCUMENTS 5,458,413 A * 10/1995 Huber ..... A47B 88/941 312/330.1
6,666,306 B2 12/2003 Gasser
(Continued)

FOREIGN PATENT DOCUMENTS

CN 101167616 A 4/2008
DE 3135222 A1 3/1983
(Continued)

OTHER PUBLICATIONS

International Search Report dated May 6, 2019 in related/corresponding International Application No. PCT/EP2019/053171.
(Continued)

*Primary Examiner* — James O Hansen
(74) *Attorney, Agent, or Firm* — Patent Portfolio Builders PLLC

(57) ABSTRACT

A piece of furniture or domestic appliance includes a body, a drawer element slidably arranged in the body and having two side walls. Respective pull-out guides are arranged between the side panels and side walls of the body. Each of the pull-out guides has at least one body rail fastenable to a side wall of the body and one running rail fastenable to the side panel. The piece of furniture or domestic appliance also includes at least one functional unit, which is coupled to one of the pull-out guides. A functional unit is detachably
(Continued)

Figure 1:
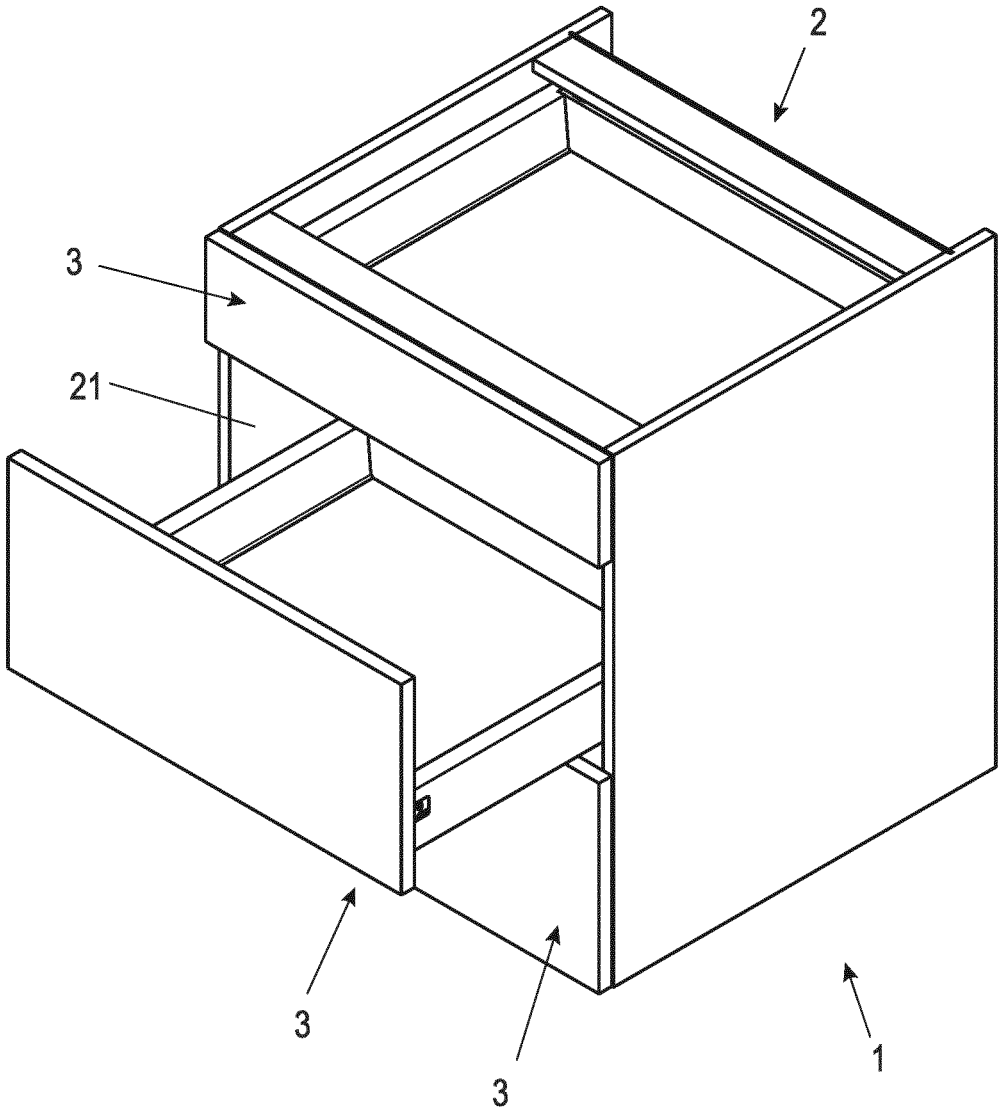

arranged in at least one of the side walls at distance from the pull-out guide, which functional unit, in a predefined position of the drawer element relative to the body, is operatively connected to a counter-element stationarily mounted on the body or on the body rail.

10 Claims, 10 Drawing Sheets

(51) Int. Cl.
*A47B 88/90* (2017.01)
*A47B 88/463* (2017.01)
*A47B 88/919* (2017.01)

(58) Field of Classification Search
USPC ..... 312/334.1, 334.7, 348.4
See application file for complete search history.

(56) References Cited

U.S. PATENT DOCUMENTS

| | | | | |
|---|---|---|---|---|
| 8,979,222 | B2 | 3/2015 | Jahrling et al. | |
| 2005/0116593 | A1* | 6/2005 | Berger | A47B 88/467 312/333 |
| 2006/0049730 | A1* | 3/2006 | Sutterlutti | A47B 88/90 312/330.1 |
| 2007/0228906 | A1* | 10/2007 | Netzer | A47B 88/956 312/348.4 |
| 2009/0039746 | A1* | 2/2009 | Lam | A47B 88/427 312/334.1 |
| 2009/0079312 | A1 | 3/2009 | Laible | |
| 2012/0288221 | A1 | 11/2012 | Jahrling et al. | |

FOREIGN PATENT DOCUMENTS

| | | | |
|---|---|---|---|
| DE | 20122622 | U1 | 8/2006 |
| DE | 102010000279 | A1 | 8/2011 |
| DE | 102011052564 | A1 | 11/2012 |

OTHER PUBLICATIONS

Search Report dated Nov. 20, 2018 in related/corresponding DE Application No. 10 2018 104 398.8.
Written Opinion dated May 6, 2019 in related/corresponding International Application No. PCT/EP2019/053171.
Examination Report dated Apr. 28, 2022 in related/corresponding IN Application No. 202047041241.

* cited by examiner

PIECE OF FURNITURE OR DOMESTIC APPLIANCE AND METHOD FOR MOUNTING A FUNCTIONAL UNIT OF A DRAWER ELEMENT IN A PIECE OF FURNITURE OR DOMESTIC APPLIANCE

BACKGROUND AND SUMMARY OF THE INVENTION

Exemplary embodiments of the present invention relate to a piece of furniture or domestic appliance, as well as a method for mounting a functional unit of a drawer element in such a piece of furniture or domestic appliance.

Such pieces of furniture or domestic appliances, in the body of which at least one displaceably arranged drawer element is arranged, for example, in the form of a drawer, are known in numerous variants from the prior art.

The drawer elements are held displaceably in the body with the aid of pullout guides in this case and can be pulled out of the body with the aid of the pullout guides or pushed therein.

For convenient operation of the at least one drawer element, the pullout guides or at least one of the pullout guides are coupled to a functional unit, for example, in the form of a self-retractor or an ejection device or a locking unit.

Such a system is known, for example, from DE 10 2010 000 279 A1 or DE 10 2011 052564 A1.

It is problematic in the pieces of furniture or domestic appliances known from the prior art that due to the arrangement of the various components, it generally has to be established during the assembly of the respective piece of furniture or domestic appliance which type of functional unit is to be installed in the piece of furniture or domestic appliance.

The respective functional unit has to be mounted together with the other components in the body of the piece of furniture to exercise the desired function.

Exemplary embodiments of the present invention are directed to a piece of furniture or domestic appliance in which such a functional unit can also be installed later in a simple manner.

Exemplary embodiments of the invention are also directed to a method for simplified installation of a functional unit of a drawer element in a piece of furniture or domestic appliance.

The piece of furniture or domestic appliance according to the invention comprises a body. At least one displaceable drawer element having two side walls is arranged in the body. Respective pullout guides are arranged between the side walls of the drawer element and side walls of the body.

Each of the pullout guides comprises at least one body rail fastenable on a side wall of the body and a slide rail fastenable on the side wall of the drawer element. The piece of furniture or domestic appliance furthermore comprises at least one functional unit coupled to one of the pullout guides.

The at least one functional unit is detachably arranged in at least one of the side walls remotely from the pullout guide in this case and, in a predetermined position of the drawer element in relation to the body, is operationally connected to a counter element attached fixed in place on the body or the body rail.

This thus enables the functional unit to be fastenable in a simple manner in the side wall of the drawer element and also detachable therefrom in a simple manner.

The arrangement of the counter element on the body or on the body rail also enables a simple and in particular later mounting of such a counter element.

The arrangement of the functional unit in the side wall of the drawer element has the further advantage of a smaller structure of the pullout guide, on which the functional unit is attached in the above-mentioned prior art.

Thus, in the case of a drawer element formed as a drawer, the bottom of this drawer can protrude significantly deeper, in particular down to the lower edge of the pullout guide, which is not thus possible in the case of functional units attached to the pullout guide. The drawer element can thus have an enlarged storage space.

According to one advantageous embodiment variant of the piece of furniture or domestic appliance according to the invention, the counter element is arranged on a rear end of the body rail in the opening direction of the drawer element or a region of the body close to the rear end of the body rail.

According to a further advantageous embodiment variant, the counter element is formed in at least two parts.

A time-offset mounting of the components of the counter element is thus enabled in a simple manner.

For example, a base part of the counter element is attached in a standard manner on the body rail or in the body. During the final mounting of the drawer element, a specific counter element is connected to the base depending on the function of the functional element to be comprised.

A further advantage of such a variant is that during the transport of the pullout guide, damage cannot occur to the counter element due to protruding components of the counter element.

According to a further advantageous embodiment variant, the functional unit is arranged in a double-walled region between two wall regions of one of the side walls, so it is not externally visible.

According to a further advantageous embodiment variant, in a rear end of the side wall in the opening direction of the drawer element, a receptacle space open toward a rear open end face is formed for accommodating the functional unit, which enables the insertion of the functional unit from the rear end of the side panel in a simple manner.

Alternatively, the functional unit can also be inserted from below or from the side or from above into a corresponding receptacle space, if the outer wall element is displaceably formed, or can only be placed later on the inner wall element.

Furthermore, at least one fastening element for the detachable fixation of the functional unit is arranged in this receptacle space.

The at least one fastening element is preferably formed in this case as a catch element for locking with at least one counter catch element formed on the functional unit.

The installation or removal of such a functional unit is thus enabled in a simple manner.

It is also conceivable, in the case of a side wall in the form of a side panel having plastic core, to form such fastening elements directly on the side panel.

This is also true for a housing or the like of the functional unit.

Other fastening options of the functional unit in the side wall are also conceivable.

According to a further advantageous embodiment variant, the counter element is in contact with the functional unit in a closed position of the drawer element through the rear open end face of the side wall.

This thus enables the rear open end of the side wall to be used both for the installation of the functional unit and also for the engagement of the counter element with the functional unit installed in the side wall.

The functional unit itself comprises a self-retractor device according to one preferred embodiment variant.

According to a further advantageous embodiment variant, the functional unit comprises an ejection device.

The functional unit can additionally comprise a damping unit, which is used for damping a retraction movement.

According to one preferred embodiment variant, the counter element is designed as an activator having a base part for fastening on the body or the body rail and a head part for engaging in the functional unit.

According to a further preferred embodiment variant, it is also conceivable that the functional unit comprises a locking unit, which is used for the releasable locking of the drawer element in its closed position.

In the method according to the invention for mounting a functional unit of a drawer element in a piece of furniture or domestic appliance as described above, before the mounting of the pullout guides on the side walls of the drawer element, the at least one functional unit is inserted through a rear open end face of the side wall or through a lower, lateral, or upper open aperture of the side wall and fastened.

The counter element is fastened on the body rail or the body.

The functional unit is arranged non-visibly in the side wall in the mounted state, possibly after finishing of the drawer element.

According to one preferred embodiment variant of the method according to the invention, a first part of a two-part counter element is permanently fastened on the body rail or the body beforehand and, after completed mounting of the functional unit in the side panel, a second part of the counter element is fixed on the first part of the counter element.

BRIEF DESCRIPTION OF THE DRAWING FIGURES

Preferred exemplary embodiments of the invention are explained in greater detail hereinafter with the aid of the appended drawings.

Figure 2:
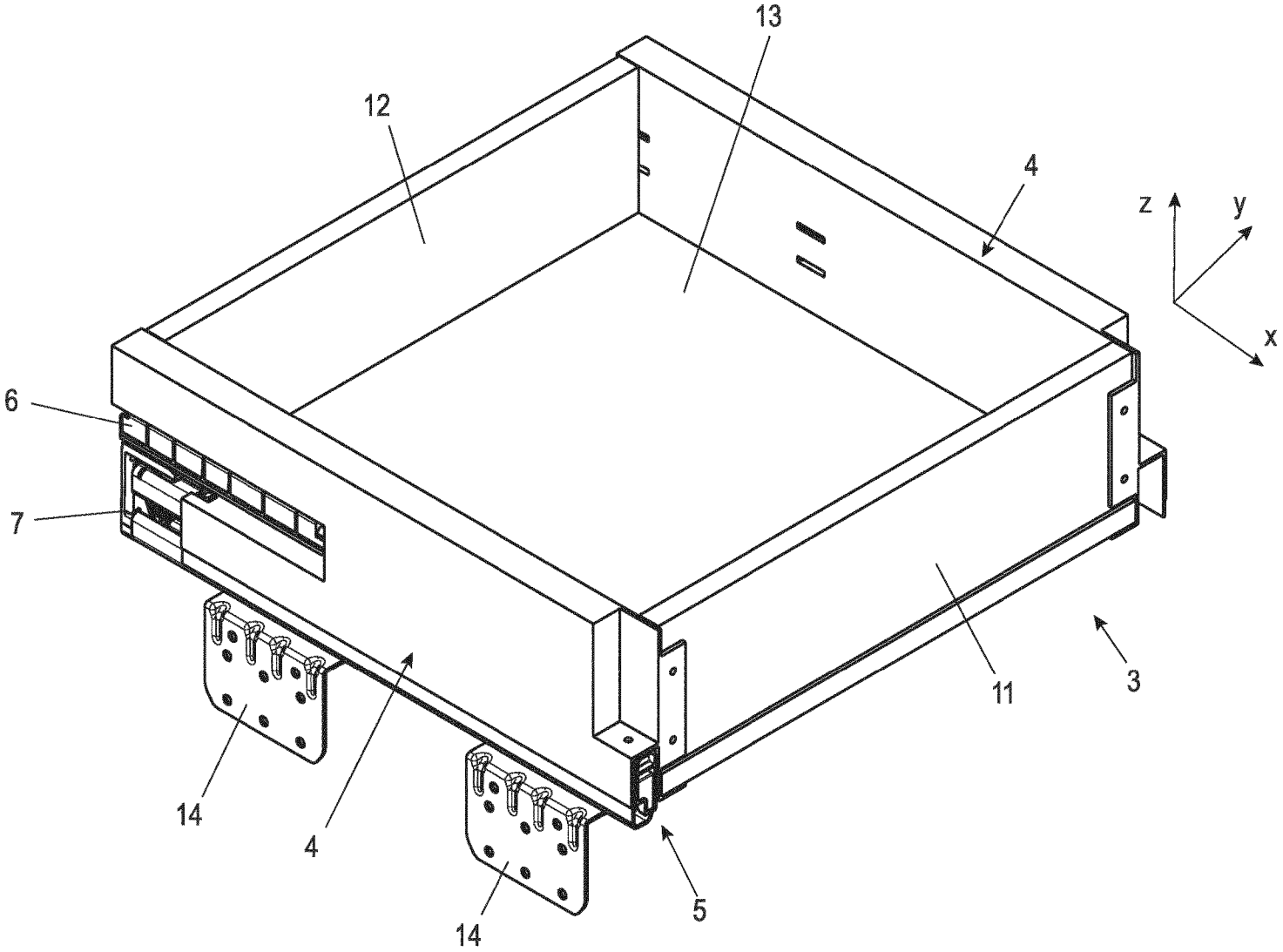
Figure 3:
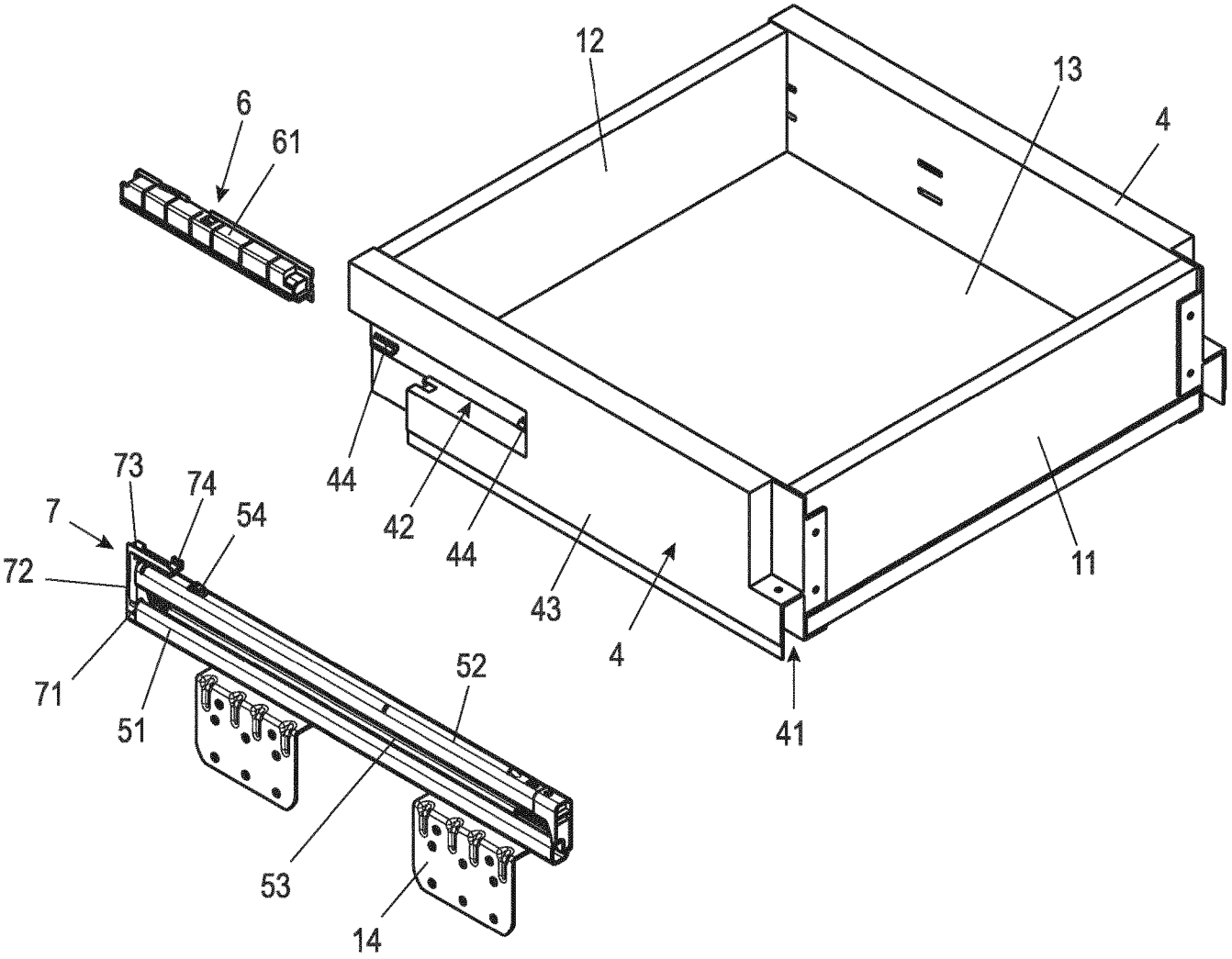
Figure 4:
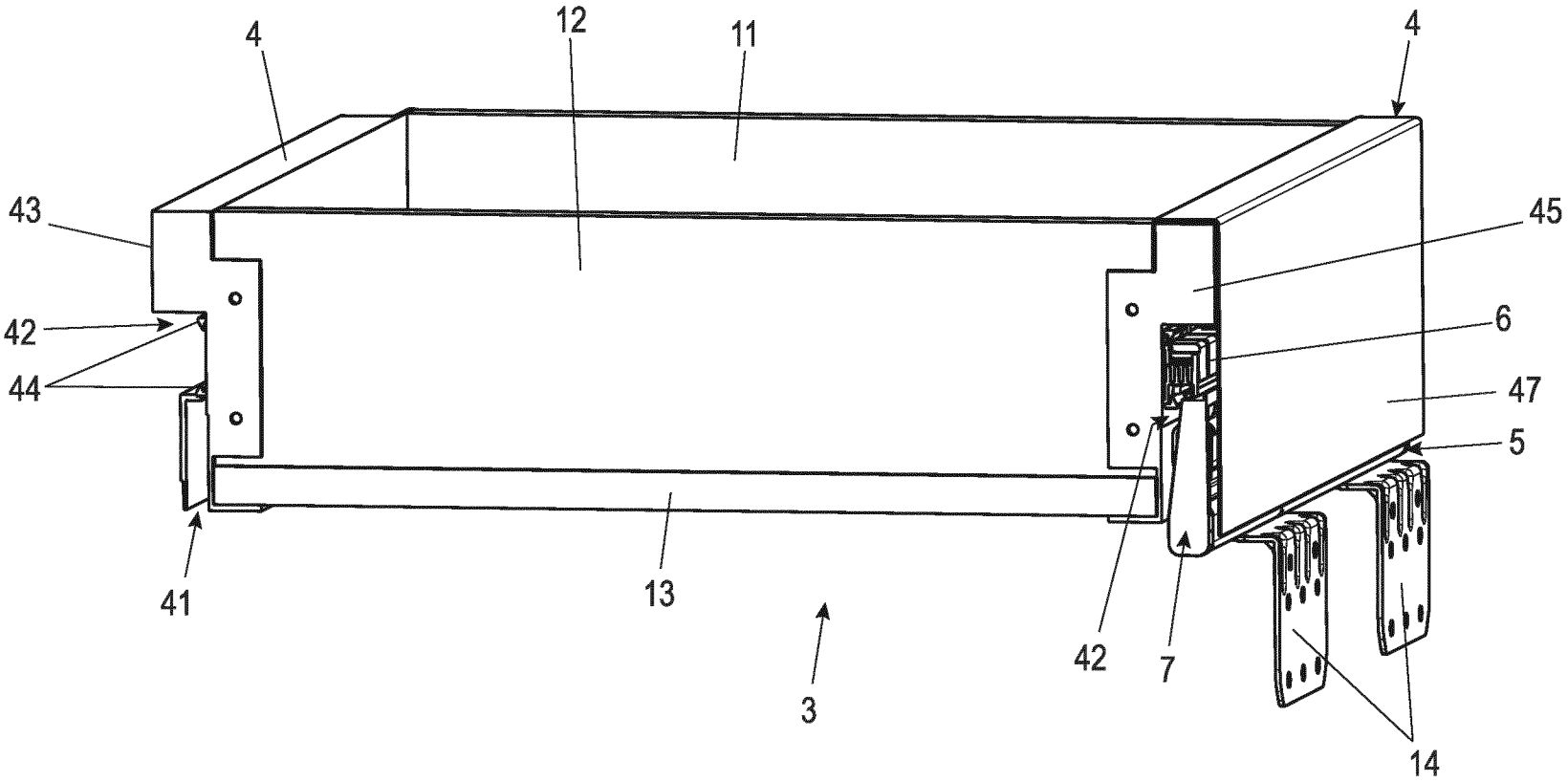
Figure 5:
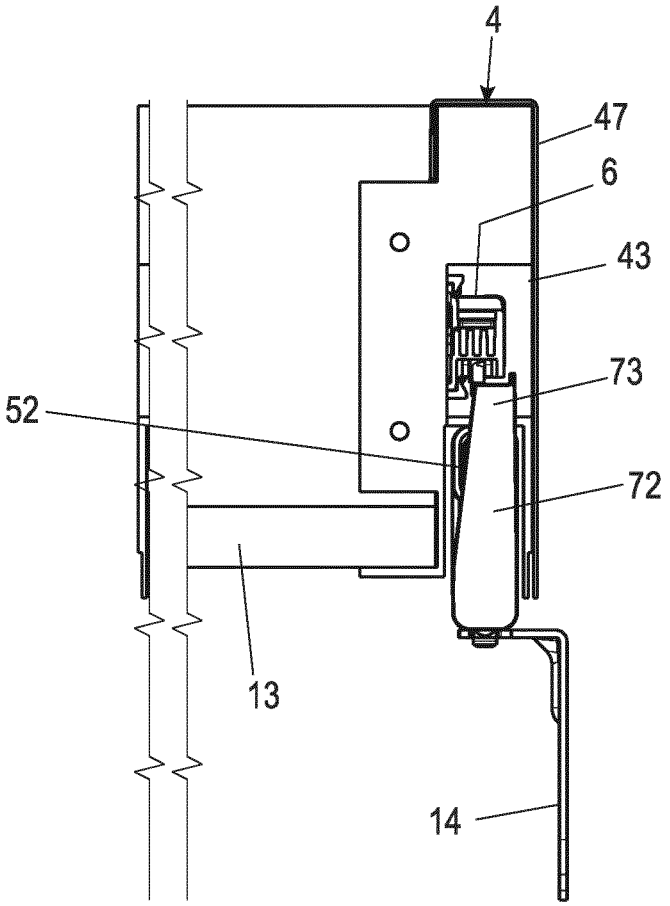
Figure 6:
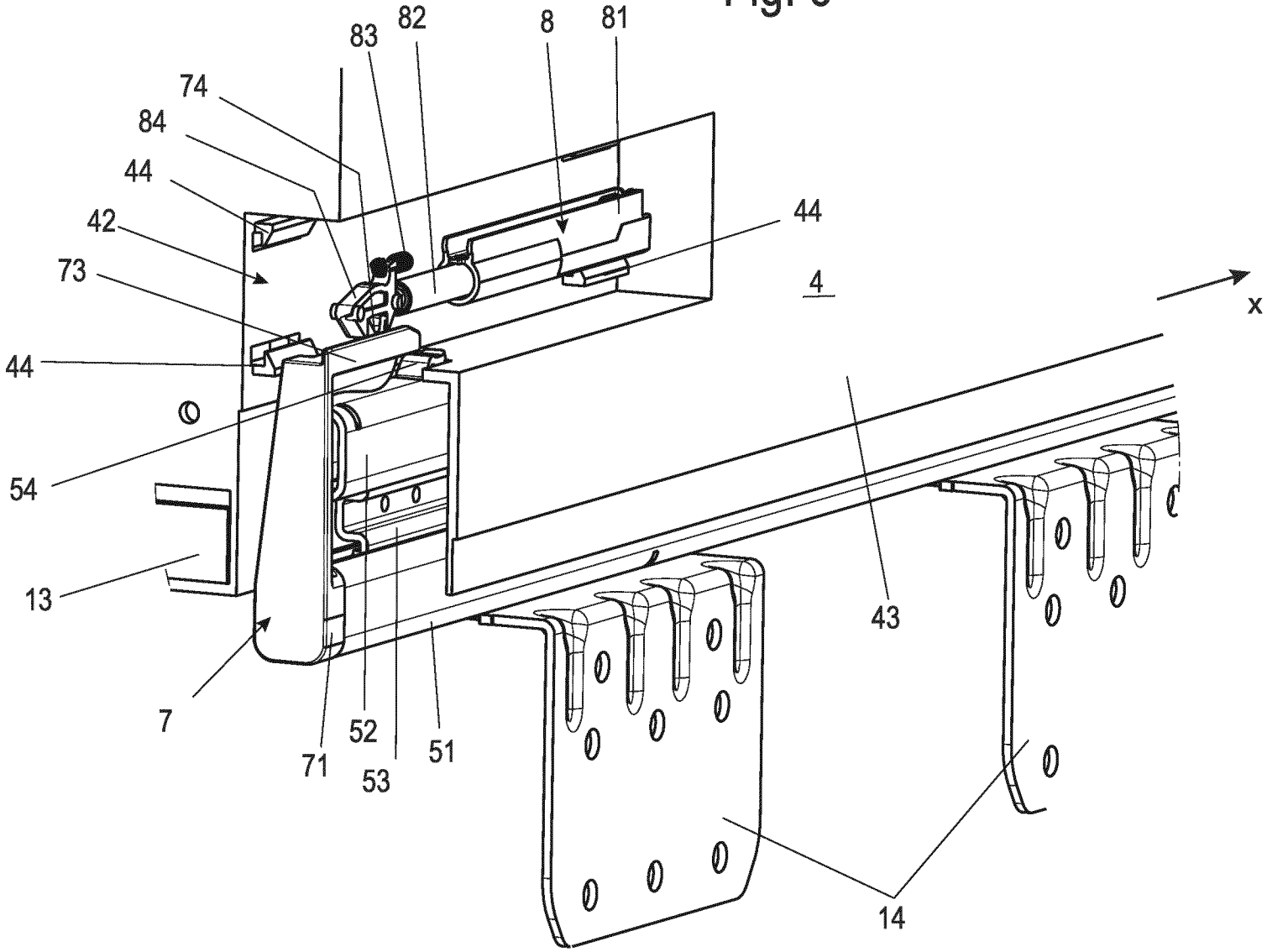
Figure 7:
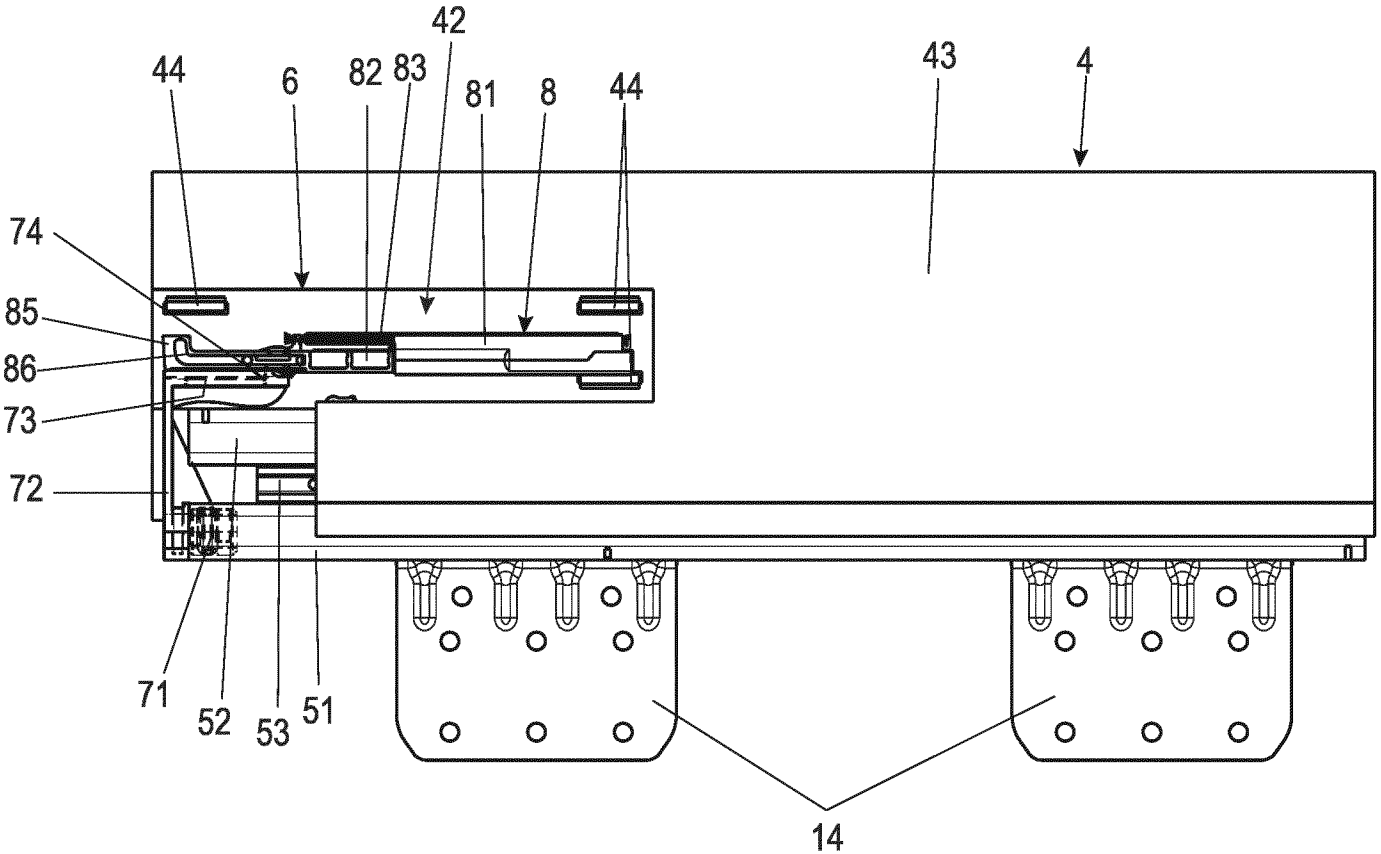
Figure 8:
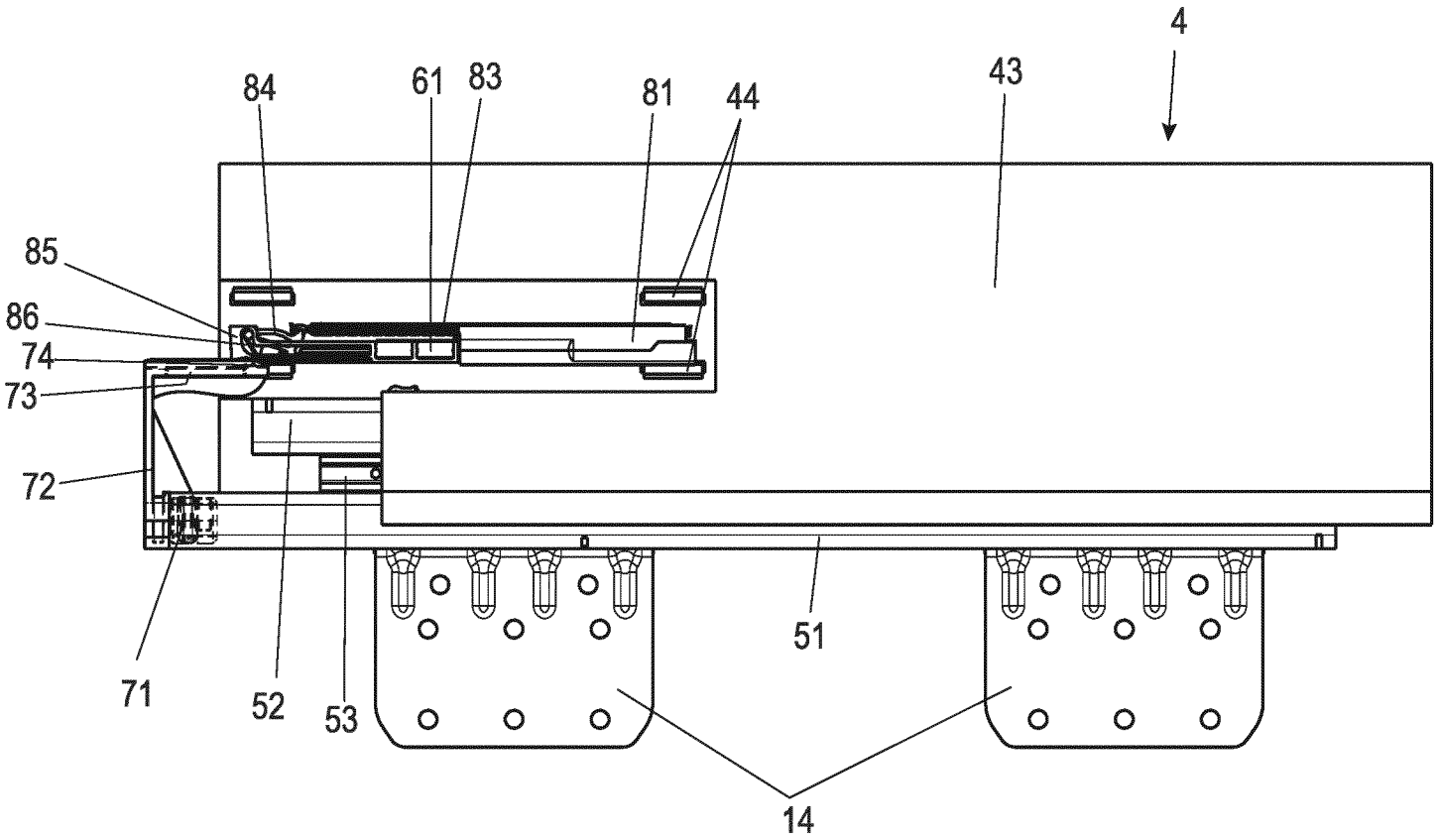
Figure 9:
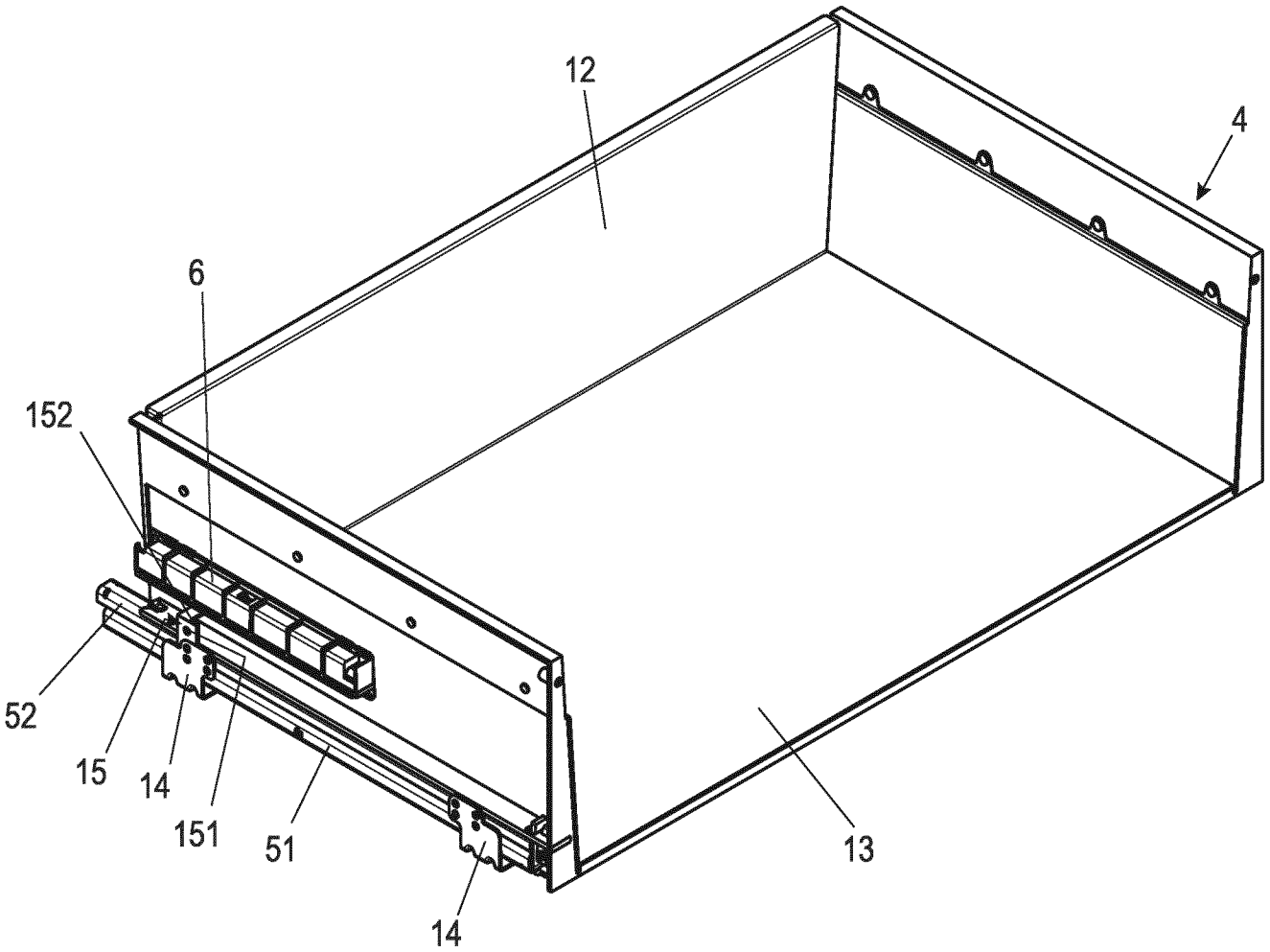
Figure 10:
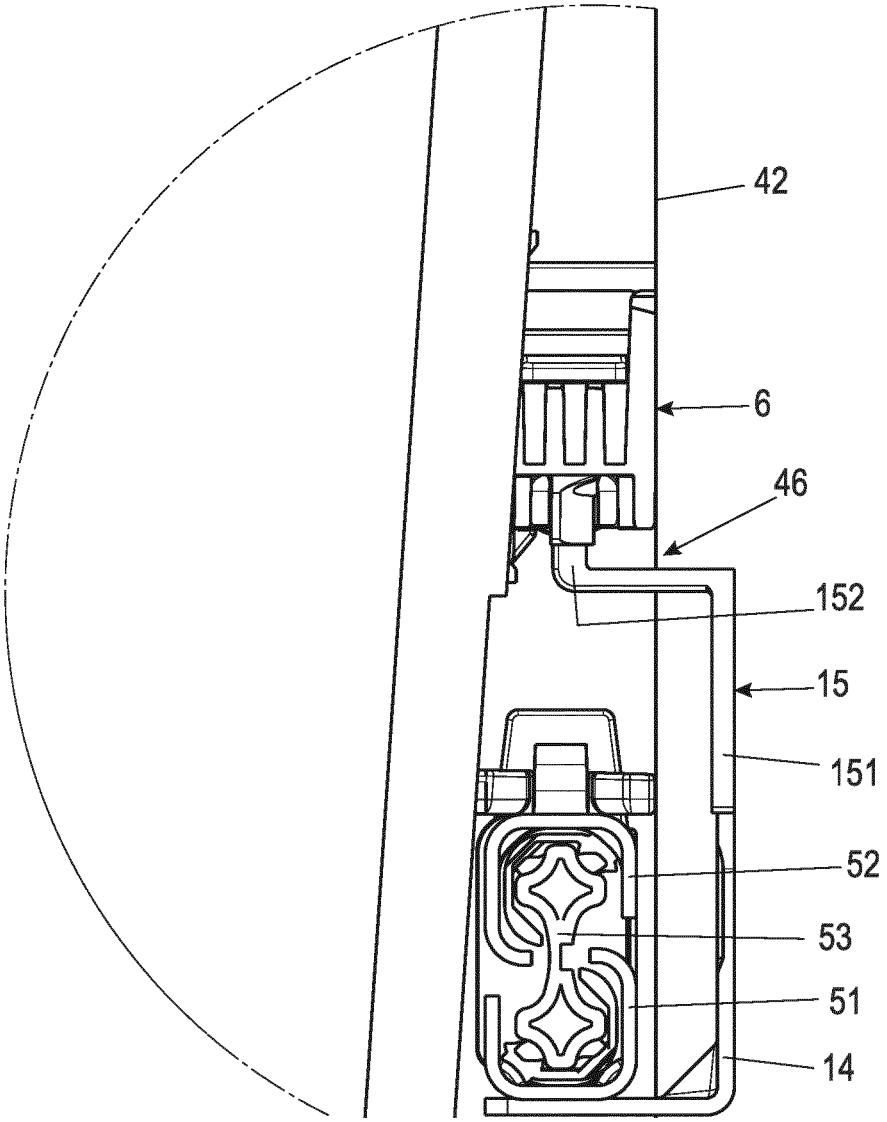

In the figures:

FIG. 1 shows a perspective view of a body of a piece of furniture or domestic appliance having drawer element installed therein, FIG. 2 shows a perspective view of a drawer element having pullout guide installed therein and angles secured on the pullout guide for fixing on the furniture body, FIG. 3 shows a perspective illustration of the drawer element corresponding to FIG. 2 before the mounting of the pullout guide and the functional unit in the side wall of the drawer element, FIG. 4 shows a perspective view from the rear of the drawer element, FIG. 5 shows a rear view of a detail of the drawer element, FIG. 6 shows a perspective illustration of a detail of the drawer element in the closed position, FIG. 7 shows a side view of the drawer element in the closed position, FIG. 8 shows a side view of the drawer element in a position displaced in the opening direction, FIG. 9 shows a perspective view of a drawer element having pullout guide attached thereon having alternative embodiment variant of a counter element, and FIG. 10 shows a rear view of the drawer element according to FIG. 9.

DETAILED DESCRIPTION

In the following description of the figures, terms such as upper, lower, left, right, front, rear, etc. relate exclusively to the illustration and position selected by way of example in the respective figures of the piece of furniture or domestic appliance, the body, the drawer element, the side wall, the pullout guide, the counter element, and the like. These terms are not to be understood as restrictive, i.e., these references can change due to different working positions or mirror-symmetrical design or the like.

An embodiment variant of a piece of furniture according to the invention is identified in FIG. 1 by the reference sign 1.

The piece of furniture 1 comprises a body 2, in the interior of which at least one drawer element 3 is mounted, in the form of a drawer here. It is also conceivable, instead of a piece of furniture 1, to provide a domestic appliance, for example, a refrigerator or freezer, with such a drawer element 3, which is installed in a body of the domestic appliance.

Angles 14 are fastened, preferably screwed on, to side walls 21, 22 of the body 2 for the displaceable installation of the drawer element 3. As can be seen in FIG. 2, a body rail 51 of a pullout guide 5 is fastened on the legs of these angles 14 aligned horizontally here.

The pullout guide 5 is accommodated, as shown, for example, in FIG. 3, in a receptacle space 41, which is open to the bottom here, of a side wall 4 of the drawer element 3 formed as a side panel.

The side wall 4 is connected here to the slide rail 52 of the pullout guide 5 via a fastening element 54. The drawer element 3 shown here additionally comprises a front wall 11, a rear wall 12, and a bottom 13.

The side walls of the drawer element 3 are preferably designed as side panels having double-walled construction. In particular in the case of drawer elements in domestic appliances, the double-walled structure does not extend over the entire height of the side wall, but rather only in a portion, for example, in the upper third.

The pullout guide 5 preferably comprises, in addition to the body rail 51 and the slide rail 52, a middle rail 53 arranged between body rail 51 and slide rail 52, as shown, for example, in FIGS. 3 and 7.

As is furthermore shown in FIG. 2, a functional unit 6 is arranged in a rear region of the side panel 4.

This functional unit 6, as is apparent in FIG. 3, is accommodated in a separate receptacle space 42 of the side panel 4 and is detachably arranged in the side panel 4 remotely from the pullout guide 5.

As shown in FIG. 4, the functional unit 6 is preferably arranged in a double-walled region so it is not visible from the outside between two wall regions of one of the side walls 4.

As illustrated in FIGS. 4 and 5, the receptacle space 42 having the functional unit 6 arranged therein is concealed toward the body side wall 21, 22 by an outer wall 47. The outer wall 47 preferably conceals the entire side wall 4 toward the body side wall 21, 22 in this case.

The outer wall 47 is preferably bent over in a U shape at its upper end and overlaps the outer wall 43 or the receptacle space 42 located underneath in this case.

Due to the arrangement of the functional unit 6 in the side wall 4 of the drawer element 3, in particular in the case of a drawer element 3 designed as a drawer, the bottom 13 of this drawer can protrude significantly lower, in particular down to the lower edge of the pullout guide 5, which enables an enlargement of the storage space of the drawer element 3.

Furthermore, in the embodiment variant shown in FIG. 2, a counter element 7, in the form of an activator here, is fastened on the body rail 51. This counter element 7 is operationally connected here to the functional unit 6 in a predetermined position of the drawer element 3 in relation to the body 2.

As is furthermore apparent in FIG. 3, the counter element 7 designed as an activator here comprises a base part 71, which is insertable into a frontal opening of the body rail 51.

A first arm 72 extends perpendicularly upward from this base part 71 up to beyond the slide rail 52. At the end of the first arm 72, a second arm 73 is formed, which extends beyond the slide rail 52 in the longitudinal direction of the slide rail 52 by a predetermined distance.

At the free end of the second arm 73, a head part 74 extends upward, which engages upward in the functional unit 6 arranged above the pullout guide 5.

The functional unit 6 is designed as a self-retractor device 8 in the embodiment variant shown in FIGS. 6-8.

The self-retractor device 8, which is known per se, comprises a housing 81 in this case, on which a damping unit 82 is fastened. A lever 84, which comprises a recess for accommodating the head part 74, is arranged at the front end of this damping unit 82.

This lever 84 is mounted here in a guide housing 85 having a guide groove 86 and is tiltable around a pivot axis aligned perpendicularly to the opening direction x.

Upon the displacement of the drawer element 3 in the opening direction x, this enables the lever 84 to move in the guide housing 85 along a guide groove extending in the opening direction x, wherein the guide housing 85 moves with the drawer element 3 in the opening direction x and the lever 84 is secured in its position by the engagement with the head part 74 of the counter element 7.

At the end of this guide groove 86, the guide groove 86 is formed as a walking stick, so that the lever 84 is pivoted into a locking position and at the same time the head part 74 of the counter element 7 disengages from the lever 84 of the self-retractor device 8.

A traction spring 83 fixed on the lever 84 and on the housing 81 is tensioned with the movement of the drawer element 3 in the opening direction x.

As soon as the drawer element 3 is subsequently again displaced from an open position into the closed position, from a predetermined position, the head part 74 of the counter element 7 engages with the lever 84 again, releases it from its locked position, and thus fixes it by way of the head part 74 in relation to the body 2.

The drawer element 3 is drawn here by the spring force of the traction spring 83 into the closed position.

The damping unit 82 causes damping of the closing movement here to prevent a hard impact of the drawer element 3 on the body 2 and/or an impact of the slide rail 52 on the body rail 51.

In addition to the arrangement of such a self-retractor device 8 in the functional unit 6, it is also conceivable additionally or alternatively thereto to integrate an ejection device or also a locking unit in the functional unit 6.

The functional unit 6 is preferably substantially enclosed by an adapter housing 61 and is installable as a whole in the receptacle space 42 of the side panel 4.

For simple fixation of the functional unit 6, as is apparent in FIGS. 3 and 6 to 8, at least one fastening element 44 is arranged for the releasable fixing of the functional unit 6.

In the embodiment variations shown here, multiple such fastening elements 44 are arranged in the receptacle space 42. Such a fastening element 44 is preferably designed here as a catch element for locking with at least one counter catch element formed on the functional unit 6.

As shown in FIGS. 2 to 8, the counter element 7 is in contact with the functional unit 6 in a closed position of the drawer element 3 through the rear open end face 45 of the side panel 4.

In the embodiment variant shown in FIGS. 9 and 10, the counter element 15 is in contact with the functional unit 6 in a closed position of the drawer element 3 through an opening 46 in an outer wall 43 of the side panel 4 facing toward the side wall 21, 22 of the body 2.

The opening 46 in the outer wall 43 of the side panel 4 is preferably embodied as slotted, so that a counter element 15 fastened on the body rail 51 or the angle 14 protrudes perpendicularly to the opening direction x into the slot. The functional unit 6 is also completely concealed by the outer wall 43 here except for the opening 46 formed as a slot for the engagement of the counter element 15.

The counter element 7, 15 is designed in the embodiment variations shown here as an activator having base part 71, 151 for fastening on the body 2 or the body rail 51 and a head part 74, 152 for engaging in the functional unit 6.

It is particularly advantageous if the counter element 7, 15 is formed in at least two parts.

In this case, it is possible during the mounting of the functional unit 6 of a drawer element 3 in a piece of furniture or domestic appliance, after completed mounting of the pullout guides 5 on the side panels 4 of the drawer element 3, to insert the functional unit 6, for example, through a rear open end face 44 of the side panel 4 and fasten it and to fasten the counter element 7, 15 on the body rail 51 or the body 2.

It is also conceivable to insert the functional unit 6 from below or from the side or from above into a corresponding receptacle space 42. For this purpose, it is conceivable, for example, to design the outer wall element 47 to be displaceable or only to place it later on the outer wall 43, which is the inner wall element in this case.

With a multipart design of the counter element 7, 15, the base part 71, 151 can be fastened beforehand on the body rail 51, the angle 14, or also on the body 2 itself and after completed mounting of the functional unit 6, a second part of the counter element 7, 15, which includes the head part 74, 152, can be mounted, in particular clipped, on the first part of the counter element 7, 15.

This has the advantage that in particular the activator arm 72, 73 is not damaged during the transportation of the pullout guide 5.

Overall, further simplified mounting, in particular with respect to the retrofitting of functional units, which can be carried out particularly simply through the mounting in an opening provided for this purpose of the side wall, results using the piece of furniture or domestic appliance according to the invention.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 piece of furniture
2 body
21 side wall
22 side wall
3 drawer element
4 side panel
41 receptacle space
42 receptacle space
43 outer wall
44 fastening element
45 end face
46 opening
47 outer wall
5 pullout guide
51 body rail
52 slide rail
53 middle rail
54 fastening element
6 functional unit
61 adapter housing
7 counter element
71 base part
72 first arm
73 second arm
74 head part
8 self-retractor device
81 housing
82 damping unit
83 traction spring
84 lever
85 guide housing
86 guide groove
11 front wall
12 rear wall
13 bottom
14 angle
15 counter element
151 base part
152 head part
x opening direction

The invention claimed is:

1. A piece of furniture or domestic appliance, comprising:

a body;

a drawer element having two side walls displaceably arranged in the body, wherein respective pullout guides are arranged between the side walls of the drawer element and side walls of the body, wherein each of the pullout guides comprises at least one body rail fastenable on one of the side wall of the body and a slide rail fastenable on one of the side wall of the drawer element;

at least one functional unit coupled to one of the pullout guides, wherein the at least one functional unit is releasably arranged in at least one of the two side walls of the drawer element remotely from one of the pullout guides;

a first receptacle space in a first one of the two side walls of the drawer element and in which one of the respective pullout guides is arranged; and a second receptacle space in a rear end of the first one of the two side walls of the drawer element in an opening direction of the drawer element, wherein the second receptacle space is open to a rear open end face of the first one of the two side walls, wherein the second receptacle space accommodates the at least one functional unit, in which at least one fastening element is arranged for releasable fixing of the functional unit, wherein the second receptacle space is separated from the first receptacle space by a bottom of the second receptacle space, wherein the at least one functional unit, in a predetermined position of the drawer element in relation to the body, is operationally connected to a counter element attached fixed in place on the body or on the body rail, and wherein, in a closed position of the drawer element, the counter element is in contact with the at least one functional unit through the rear open end face of the first one of the two side walls of the drawer element, or an opening in an outer wall of the first one of the two side walls of the drawer element facing toward one of the side walls of the body.

2. The piece of furniture or domestic appliance of claim 1, wherein the counter element is arranged on a rear end of the body rail in an opening direction of the drawer element or a region of the body close to a rear end of the body rail.

3. The piece of furniture or domestic appliance of claim 1, wherein the counter element is formed in at least two parts.

4. The piece of furniture or domestic appliance of claim 1, wherein the functional unit is arranged in a double-walled region so it is not externally visible between two wall regions of one of the side walls of the drawer element.

5. The piece of furniture or domestic appliance of claim 1, wherein the at least one fastening element is a catch element for locking with at least one counter catch element formed on the at least one functional unit.

6. The piece of furniture or domestic appliance of claim 1, wherein the at least one functional unit comprises a self-retractor device.

7. The piece of furniture or domestic appliance of claim 6, wherein the at least one functional unit further comprises a damping unit fastened to the self-retractor device.

8. The piece of furniture or domestic appliance of claim 6, wherein the counter element is an activator having a base part for fastening on the body or the body rail and a head part for engaging in the at least functional unit.

9. The piece of furniture or domestic appliance of claim 1, wherein the at least one functional unit comprises an ejection device.

10. The piece of furniture or domestic appliance of claim 1, wherein the at least one functional unit comprises a locking unit.

* * * * *